US006231295B1

(12) United States Patent
Girstenbrei et al.

(10) Patent No.: US 6,231,295 B1
(45) Date of Patent: May 15, 2001

(54) DETACHABLE FRONT-LOADER

(75) Inventors: Erich Girstenbrei, Biessenhofen; Horst-Martin Weident; Peter Reiterer, both of Marktoberdorf, all of (DE)

(73) Assignee: AGCO GmbH & Co (DE)

( * ) Notice: Subject to any disclaimer, the term of this patent is extended or adjusted under 35 U.S.C. 154(b) by 0 days.

(21) Appl. No.: 09/335,252

(22) Filed: Jun. 17, 1999

(30) Foreign Application Priority Data

Jun. 18, 1998 (GB) ..... 9813055

(51) Int. Cl.[7] ..... E02F 3/36
(52) U.S. Cl. ..... 414/686; 172/274
(58) Field of Search ..... 414/686; 172/272–275

(56) References Cited

U.S. PATENT DOCUMENTS 4,257,730 * 3/1981 Kawakita ..... 414/686
4,275,984 * 6/1981 Lenertz ..... 172/274 X
4,522,554 6/1985 Williams et al. .
5,129,780 7/1992 Stumpe .

FOREIGN PATENT DOCUMENTS 0479708 4/1992 (EP) .

* cited by examiner

*Primary Examiner*—Donald W. Underwood
(74) *Attorney, Agent, or Firm*—MacMillan, Sobanski & Todd, LLC

(57) ABSTRACT

A detachable front-loader comprising a loader assembly consisting of two arms (1) joined by one or more transverse members (2,3) as shown in FIG. 1. Each arm (1) is provided with a supporting device comprising a pivotable support foot (9) and a telescopic strut (10). Each support device is movable between a non-operational position wherein the support foot (9) rests against a respective arm (1), and an operational position. The foot (9) is retained in the operational position by locking the telescopic strut (10) in an extended state. Opposing ends (15,16) of the strut are provided with screw threads **(15*a*,16*a*) which are connected to threaded members (13,14) pivotally located on the foot (9) and the arm (1)**.

20 Claims, 3 Drawing Sheets

DETACHABLE FRONT-LOADER

BACKGROUND OF THE INVENTION

The invention relates to a detachable front-loader with a loader assembly consisting of two arms joined by one or more transverse members, the arms being assigned a supporting device having a supporting foot attached to the terminal region at the tool-end of the arm, and the device being pivotable between a non-operational position and an operational position, whereby the device is retained on the assembly when in the non-operational position and in the operational position the position relative to the arms is determined by means of a supporting strut acting between the arms and supporting foot.

A known device for supporting a detachable front-loader consists of a supporting foot which is retained against the loader arm by means of a locking bolt when the foot is pivoted up into a non-operation position. In order to detach the front loader, the supporting foot is pivoted downwards after removal of the locking bolt and locked in one of several operational positions. The operational positions are predetermined by holes in the supporting foot, in which the above-mentioned locking bolt can be inserted. The actual detaching procedure is effected with the aid of the hydraulic system of the vehicle by tipping the loading tool, eg a shovel, of the front loader which has been positioned beforehand on the ground.

The disadvantage of this arrangement is that, if the hydraulic system fails, the front-loader cannot be dismounted from the vehicle. In addition, because the holes are spaced at a relatively large distance apart from one another, it is not possible to adjust the supporting feet on uneven terrain and the supporting struts in particular cannot be adjusted under load. Consequently, the supporting feet cannot be braced firmly on the ground immediately before the front loader is dismounted. This means that every time the front loader is dismounted from the vehicle, the situation is critical in that any lateral movements or rocking of the front-loader might cause damage to the vehicle.

SUMMARY OF THE INVENTION

The objective of the invention is to provide a detachable front loader which can be mounted and dismounted in a straightforward manner, by manipulation of the supporting device and without risk of damaging the vehicle.

Accordingly there is provided a detachable front-loader with a loader assembly, consisting of two arms joined by one or more transverse members, each of the arms being provided with a supporting device having a supporting foot attached to the terminal region at the tool-end of the respective arm, the foot being pivotable between a non-operational position and an operational position, wherein each foot is retained on a respective arm in the non-operational position and in the operational position, the position of each foot relative to the respective arm is determined by a respective supporting strut acting between the arm and the supporting foot, characterised in that the struts remain pivotally joined between the linking arm and the supporting foot and the effective length of the supporting struts can be adjusted under load.

The objective is achieved owing to the fact that the effective length of the supporting strut under load can be continuously adjusted, and the supporting struts remain pivotally joined to the linking arm and the supporting foot at the end face. This means that once they have been pivoted into the operational position, the two supporting feet can be supported on the ground with the same force by individually adjusting the supporting struts. When the front-loader is then uncoupled from the vehicle, which can be done either with the aid of the hydraulic system of the vehicle or by manually adjusting the length of the supporting struts, the front-loader will not be susceptible to uncontrolled movements which might cause damage to the vehicle.

For practical purposes, one embodiment of the invention has the following features:

- a supporting strut consisting of two tubes telescopically inserted one inside the other, each provided with threading at its free end, one being a right-hand-thread and the other a left-hand-thread,
- the threads co-operate with matching threads of threaded bolts which are coupled with the linking arm and the supporting foot, and
- the tubes can be made to rest in a predetermined position so that they do not move relative to one another by means of a locking bolts, which is inserted through transverse bores of the tubes when they are flush with one another.

In the case of one particularly practical embodiment of the invention, which produces very little in the way of compressive forces in the supporting strut and allows the length of the supporting strut to be manually adjusted, when the front-loader is parked, one end of the supporting strut is placed more or less at the centre of the supporting foot whilst the other end is attached to the loader arm in such a way that, if viewed from the side, it is more or less aligned with the centre of gravity of the loader arm.

Other advantageous features of the invention are set out in the dependent claims. A hydraulic cylinder can be provided as a supporting strut, which will enable the front-loader to be mounted and dismantled from the driver's cab.

DETAILED DESCRIPTION

Figure 1:
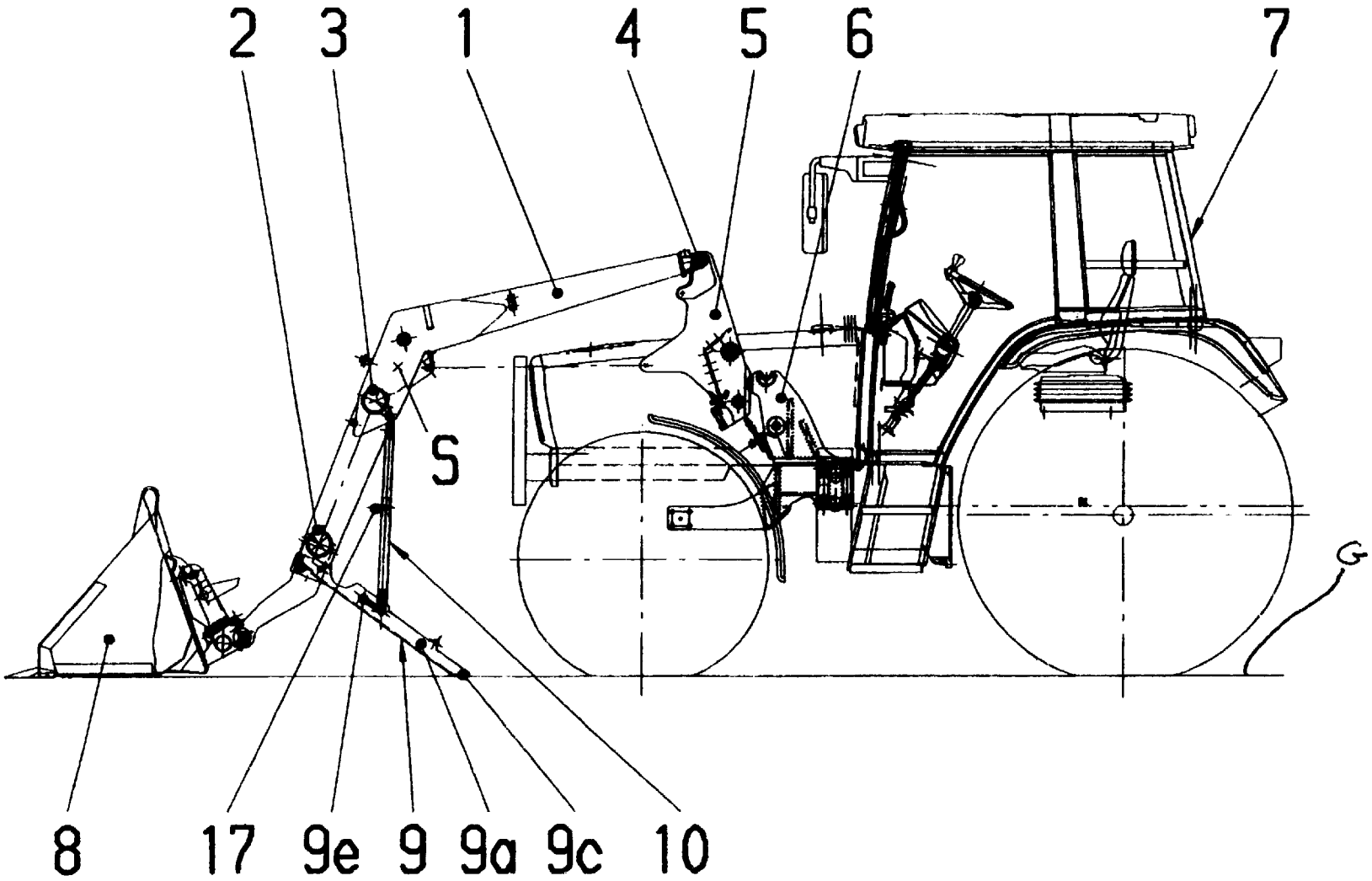
FIG. 1 shows a parked front-loader and a vehicle specifically designed for mounting the front-loader.

The front loader has two lateral linking arms 1 spaced apart from one another, which are joined to one another by means of two tubular members 2, 3 to form a loader arm. At the proximal region of the loader arm at the vehicle end, the linking arms 1 are attached by means of an articulated joint 4 to a frame 5, which can be mounted in matching holders 6 on a carrier vehicle 7.

At the distal region of the loader remote from the vehicle 7, a shovel 8 is attached, which is retained parallel with the ground by means of a parallelogram rod-linkage, not illustrated, regardless of the position of the loader arm. The shovel 8 can be pivoted by means of an adjusting cylinder.

Figure 3:
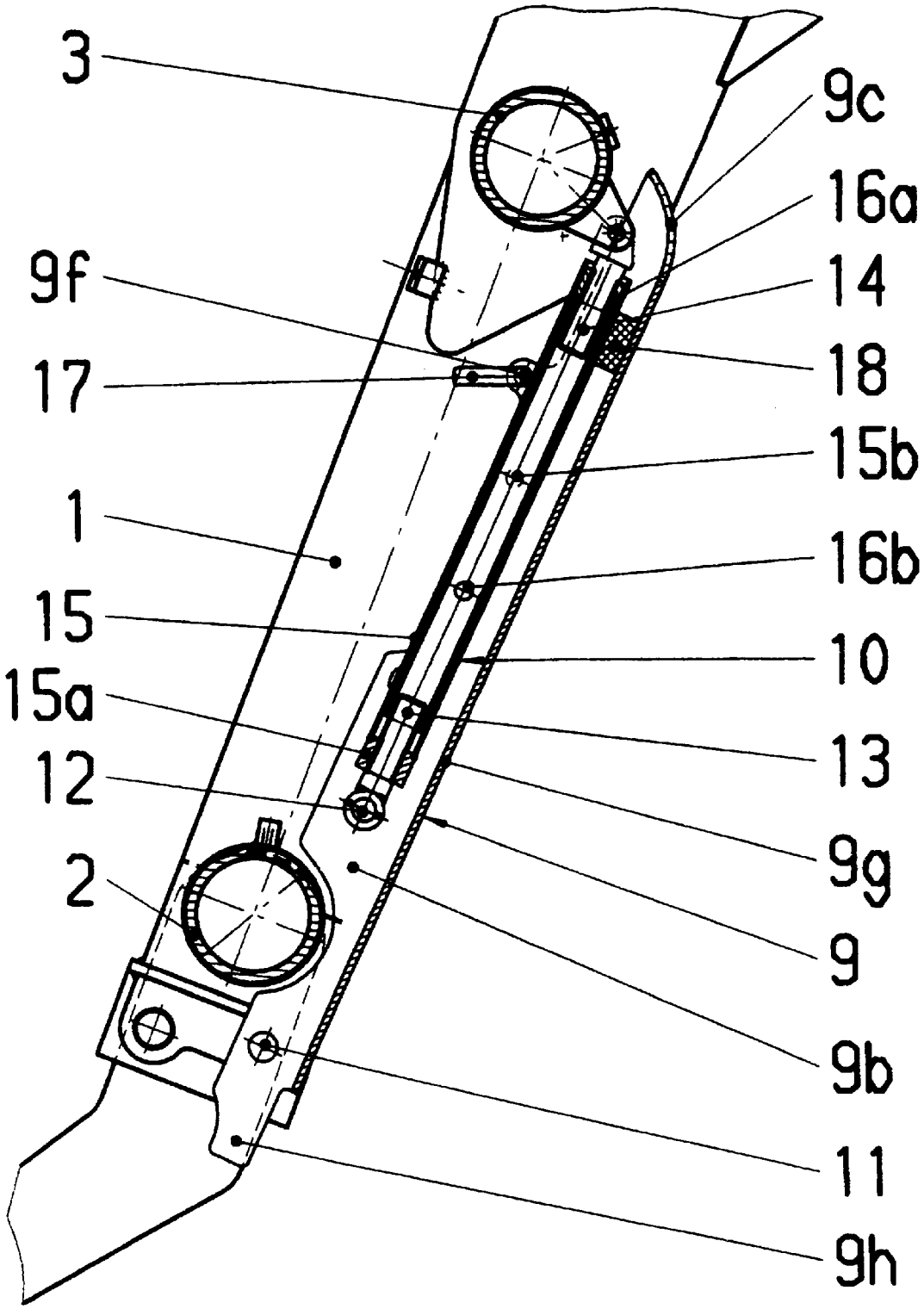
FIG. 3 is a detail of the loader arm with a supporting strut pivoted into the non-operational position.

Each linking arm 1 is provided with a supporting assembly to support the front loader when it is detached from the carrier vehicle 7. The assembly comprises a supporting foot 9 and a supporting strut 10. The supporting foot 9 is attached to the inner side of the linking arm 1 underneath the lower tubular member 2 by means of an articulated joint 11 in such a way that in the non-operational position, which is illustrated in FIG. 3, it lies almost completely within the contour of the loader arm 1. The supporting foot 9 has a unshaped cross-section, with side walls 9*a*, 9*b* Located in each side in walls 9*a*, 9*b*, approximately midway between the articulated joint 11 and the end 9*c* which, in use, lies on the ground, is an 'L' shaped slot. The slot comprises a larger hole portion 9*e* running substantially parallel to the longitudinal direction of the foot 9, and a shorter hole portion 9*d* running at right angles to the longitudinal direction of the foot 9. Inserted in the slot 9 is a bolt 12 provided with a head 12*a* at both ends, on which a threaded bolt 13 with a left-hand thread is pivotably mounted.

A further threaded bolt 14 with a right-hand thread is pivotally mounted on the upper tubular member 3. The strut 10 comprises two tubes 15, 16 provided telescopically one inside the other. The outer end of each tube 15, 16 has an internal thread l5*a*, 16*a* which corresponds to the threads on the bolts 13, 14. The strut 10, in use, supports the foot 9 in the operational position shown in FIG. 1. In this position, the two tubes 15, 16 are located in such a position relative to one another that a transverse bore 15*b*, 16*b* provided in each of the tubes 15, 16 can be brought into alignment by rotating one of the tubes relative to the other. With the bores 15*b*, 15*c* aligned the tubes 15, 16 can be secured by manually inserting a locking bolt 17, and thus are prevented from rotating or sliding relative to one another. The diameter of the tubes 14, 15 is less than the width between the side walls 9*a*, 9*b* so that the supporting strut 10 is able to lie within the cross-section thereof when the supporting foot 9 is pivoted into the non-operational position. To ensure that the supporting foot 9 remains in this position and does not inadvertently fall out into the operational position, the side walls 9*a*, 9*b* are each provided with a hole 9*f*, into which the locking bolt 17 can be inserted, such that it rests behind the outer tube 15. In order to prevent undesirable movements and noises, a stop 18 made from a rubber elastic material is arranged between the base 9*g* of the supporting foot 9 and the supporting strut 10, which pushes the supporting strut 10 against the locking bolt 17.

The elongated hole portions 9*e* extending the longitudinal direction of the supporting foot 9 allow the length of the supporting strut 10 to be selected, in use, so that it is more or less aligned with the centre of gravity S of the loader arm when the front-loader is parked. This arrangement minimises the bending forces experienced, in use, by the supporting strut 10.

Figure 2:
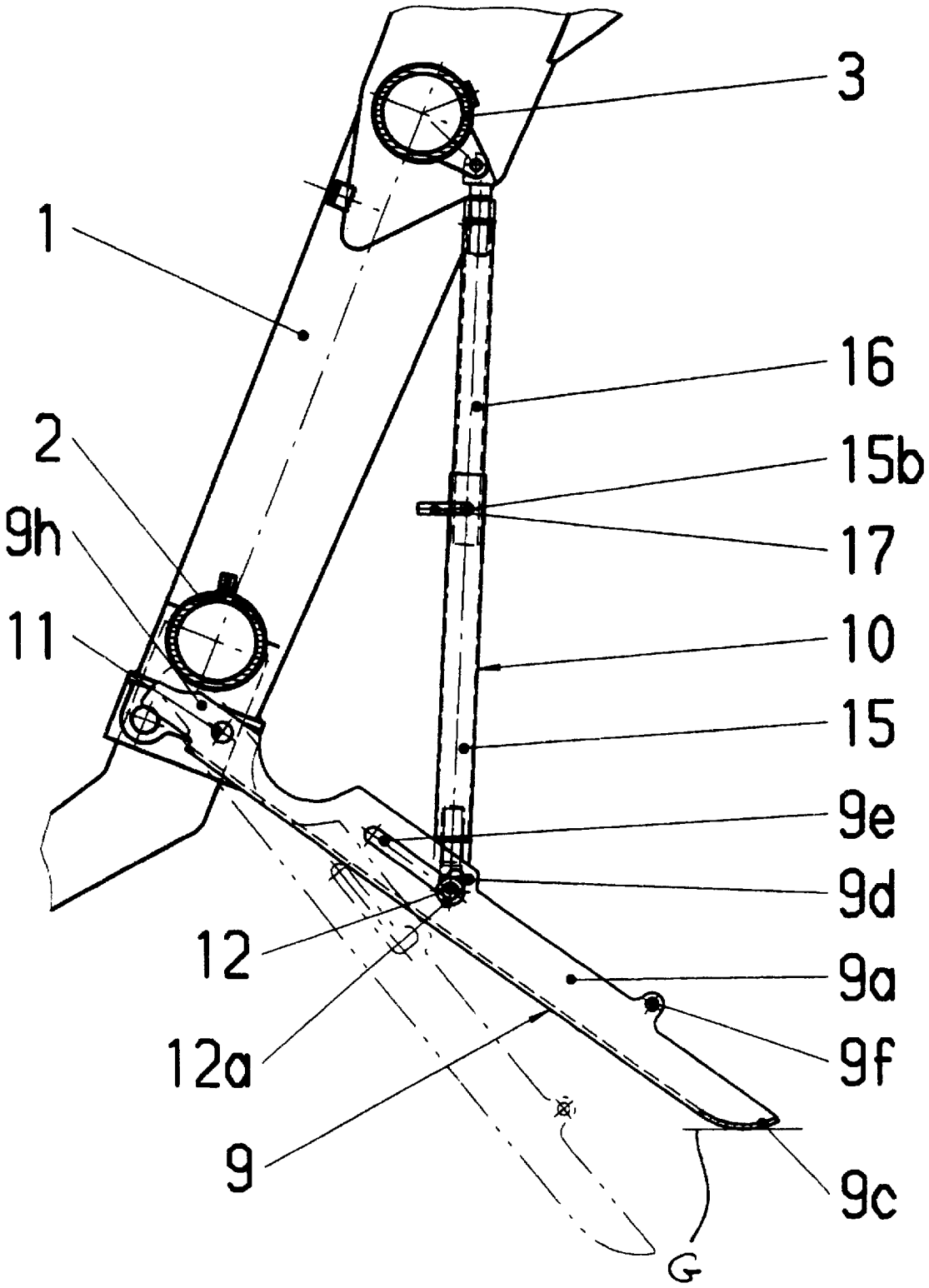
FIG. 2 is a detail of the front-loader of FIG. 1.

A short extension-piece 9*h* of the supporting foot 9 beyond the articulated joint 11 is designed to act as a stop which limits the range of the downward pivoting movement of the supporting foot 9 by bearing against the tube member 2 This serves to prevent the supporting foot 9 from pivoting enough to cause the tubes 15, 16 to slide apart from one another. The extreme position of the supporting foot is illustrated in FIG. 2 by the dot-and-dash lines.

The procedure for dismantling a front-loader will be described below.

Initially, the front-loader is secured to the vehicle and both supporting feet 9 are pivoted into the non-operational position, as can be seen in FIG. 3. The tubes 15, 16 are fully screwed down on to the relevant threads of the threaded bolts 13, 14 so that the supporting strut 10 assumes the position in which it is at its smallest possible, length, with the bolt 12 being located at the end of the elongated hole portions 9*e* closest the joint 11. In this position, the supporting strut 10 is retained by means of the locking bolt 17 inserted into the holes 9*f* in the side walls of the supporting foot 9.

Once the locking bolt 17 has been removed, the supporting foot 9 can be pivoted down into the operational position so that the outer tube 15 slides downwards on the innertube 16, and the bolt 12 slides to the other end of the elongated hole portion 9*e*. The pivoting movement of the foot 9 is stopped before the tubes 15, 16 can slide out from one another because the extension 9*h* on the tube 2 insert.

The loader shovel 8 is then set down with its front edge on the ground by lowering the loader arm onto the ground G. During this procedure, the end 9*c* of the supporting foot 9 contacts the ground and slides to the position illustrated in FIG. 2. As soon as the transverse bores 15*b* and 16*b* are positioned at the same height, the two tubes are joined to one another by inserting the locking bolt 17. The supporting foot 9 is able to pivot a little further because the bolt 12 runs in the holes 9*d* and is retained in this position. The tubes 15, 16 can then be manually rotated on the locking bolt 17 and the supporting feet 9 braced firmly against the ground, thereby accommodating any unevenness in the ground surface. If the loader shovel 8 is now tipped so that its entire surface lies on the ground, this action will cause the frame 5 of the front loader to lift out of the holders 6 at the vehicle end, as illustrated in FIG. 1. After uncoupling the hydraulic lines connecting the vehicle to the front-loader, the vehicle can be taken out of the frame 5.

If necessary, eg if the hydraulic system of the carrier vehicle 7 fails, the frame 5 can be separate from the holders 6 by manually rotating the tubes 15, 16 further in the direction in which the supporting strut 10 will be lengthened.

What is claimed is:

1. A detachable front loader assembly for use with a vehicle comprising:

first and second arms having a transverse member extending therebetween, said first arm having a first threaded member provided thereon; and a supporting device provided on said first arm, said supporting device including a supporting foot that is pivotably connected to said first arm and movable between an operational position and a non-operational position, said supporting foot having a second threaded member provided thereon;

a strut extending between said first arm and said supporting foot, said strut including a first tube having a threaded end that is threaded onto said first threaded member provided on said first arm and a second tube having a threaded end that is threaded onto said second threaded member provided on said supporting foot, said first and second tubes being disposed telescopically relative to one another and having respective bores formed therethrough that are capable of being aligned with one another for receiving a locking member therethrough to lock said first and second tubes in a predetermined position relative to one another.

2. A detachable front loader assembly for use with a vehicle comprising:

first and second arms having a transverse member extending therebetween;

a supporting device provided on said first arm, said supporting device including a supporting foot that is pivotably connected to said first arm and movable between an operational position and a non-operational position, said supporting foot having a pair of spaced apart side walls having respective L-shaped slots formed therethrough; and a supporting strut extending between said first arm and said supporting foot, said supporting strut including a first tube having an end that is pivotably connected to said first arm and a second tube having an end that is connected to said supporting foot by a member that extends into said L-shaped slots formed in said supporting foot, said first and second tubes being disposed telescopically relative to one another.

3. A detachable front loader assembly for use with a vehicle comprising:

first and second arms having a transverse member extending therebetween, a supporting device provided on said first arm, said supporting device including a supporting foot that is pivotably connected to said first arm and movable between an operational position and a non-operational position, said supporting foot having a pair of spaced apart side walls having respective apertures formed therethrough, said supporting foot further having a stop formed from resilient material provided between said spaced apart side walls; and a supporting strut extending between said first arm and said supporting foot, said supporting strut including a first end that is pivotably connected to said first arm and a second end that is pivotably connected to said supporting foot, said strut being disposable between said spaced apart side walls of said supporting foot and in abutment with said stop when said supporting foot is located in said non-operational position such that a locking member can extend between said apertures of said side wall to retain said supporting foot in said non-operational position.

4. A detachable front loader assembly for use with a vehicle comprising:

first and second arms having a transverse member extending therebetween;

a supporting device provided on said first arm, said supporting device including a supporting foot that is pivotably connected to said first arm and movable between an operational position and a non-operational position, said supporting foot including an extension that is engageable with said transverse member to prevent said supporting foot from pivoting beyond the operational position; and a supporting strut extending between said first arm and said supporting foot.

5. The detachable front loader assembly defined in claim 1 wherein said first threaded member is pivotably connected to said first arm.

6. The detachable front loader assembly defined in claim 1 wherein said second threaded member is pivotably connected to said supporting foot.

7. The detachable front loader assembly defined in claim 1 wherein said second threaded member is slidably supported in a slot formed through said supporting foot.

8. The detachable front loader assembly defined in claim 7 wherein said slot is generally L-shaped.

9. The detachable front loader assembly defined in claim 2 further including a threaded member pivotably connected to said first arm, said end of said first tube being threaded onto said threaded member to pivotably connect said supporting strut to said first arm.

10. The detachable front loader assembly defined in claim 2 wherein said member is a threaded member, said end of said second tube being threaded onto said threaded member to connect said supporting strut to said supporting foot.

11. The detachable front loader assembly defined in claim 2 further including a first threaded member pivotably connected to said first arm, said end of said first tube being threaded onto said first threaded member to pivotably connect said supporting strut to said first arm, and wherein said member is a second threaded member, said end of said second tube being threaded onto said second threaded member to connect said supporting strut to said supporting foot.

12. The detachable front loader assembly defined in claim 2 wherein said first and second tubes have respective bores formed therethrough that are capable of being aligned with one another for receiving a locking member therethrough to lock said first and second tubes in a predetermined position relative to one another.

13. The detachable front loader assembly defined in claim 3 further including a threaded member pivotably connected to said first arm, said first end of said supporting strut being threaded onto said threaded member to pivotably connect said supporting strut to said first arm.

14. The detachable front loader assembly defined in claim 3 further including a threaded member pivotably connected to said supporting foot, said second end of said supporting strut being threaded onto said threaded member to connect said supporting strut to said supporting foot.

15. The detachable front loader assembly defined in claim 3 wherein said supporting strut includes first and second tubes having respective bores formed therethrough that are capable of being aligned with one another for receiving a locking member therethrough to lock said first and second tubes in a predetermined position relative to one another.

16. The detachable front loader assembly defined in claim 4 wherein said supporting strut includes a first tube having an end that is connected to said first arm and a second tube having an end that is connected to said supporting foot, said first and second tubes being disposed telescopically relative to one another.

17. The detachable front loader assembly defined in claim 16 wherein said first tube has a threaded end that is threaded onto a first threaded member provided on said first arm, and wherein said second tube has a threaded end that is threaded onto a second threaded member provided on said supporting foot.

18. The detachable front loader assembly defined in claim 17 wherein said first threaded member is pivotably connected to said first arm.

19. The detachable front loader assembly defined in claim 17 wherein said second threaded member is pivotably connected to said supporting foot.

20. The detachable front loader assembly defined in claim 17 wherein said first and second tubes have respective bores formed therethrough that are capable of being aligned with one another for receiving a locking member therethrough to lock said first and second tubes in a predetermined position relative to one another.

* * * * *